US005738118A

United States Patent [19]

Ikoma

[11] Patent Number: 5,738,118

[45] Date of Patent: Apr. 14, 1998

[54] APPARATUS FOR COLLECTING CIGARETTE SMOKE, ASH AND CIGARETTE ENDS

[75] Inventor: Kenji Ikoma, Kitakyushu, Japan

[73] Assignee: Profix Co., Ltd., Fukuoka-ken, Japan

[21] Appl. No.: 779,891

[22] Filed: Jan. 7, 1997

[30] Foreign Application Priority Data

Apr. 4, 1996 [JP] Japan ..... 8-110157

[51] Int. Cl.[6] ..... A24F 13/00; A61J 19/04

[52] U.S. Cl. ..... 131/328; 131/329; 131/173; 4/262

[58] Field of Search ..... 131/328, 329, 131/173; 4/262, 266, 317, 318

[56] References Cited

U.S. PATENT DOCUMENTS

| | | | |
|---|---|---|---|
| 1,040,154 | 10/1912 | Cryar | 4/262 |
| 3,964,112 | 6/1976 | Plowman | 4/262 |
| 4,115,879 | 9/1978 | Toms | 4/318 |

FOREIGN PATENT DOCUMENTS

| | | | |
|---|---|---|---|
| 56-3027 | 1/1981 | Japan | A63F 7/02 |
| 62-202196 | 12/1987 | Japan | A24F 19/00 |
| 3-8236 | 2/1991 | Japan | A63F 7/02 |
| 5-68297 | 9/1993 | Japan | A24F 19/00 |
| 6-254255 | 9/1994 | Japan | A63F 7/02 |
| 6-66772 | 9/1994 | Japan | A63F 7/02 |

*Primary Examiner*—V. Millin
*Assistant Examiner*—Charles W. Anderson
*Attorney, Agent, or Firm*—Sughrue, Mion, Zinn, Macpeak & Seas, PLLC

[57] ABSTRACT

An apparatus for collecting cigarette smoke, ashes and cigarette ends is provided with a water path tube 5 disposed below a base plate 2 and has an appropriate inclination angle. Ash tray sections 3 are disposed on the upper surface of the base plate 2 at appropriate intervals. A water circuit includes a water tank 6 disposed at the downstream side of the water path tube 5, a pump 7 for feeding water in the water tank 6 to the upstream side of the water path tube 5 and a water feeding tube 8 connecting the pump 7 and the upstream side of the water path tube 5. A water splash prevention section 9 is fitted on the upper end of the water tank 6. A suction port 10 is disposed on the upper surface of the water path tube 5, a suction tube 11 communicates with the suction port 10, and a suction section 12 consisting of a blower is connected to the suction tube 11 for sucking smoke into the water path tube 5.

11 Claims, 10 Drawing Sheets

APPARATUS FOR COLLECTING CIGARETTE SMOKE, ASH AND CIGARETTE ENDS

BACKGROUND OF THE INVENTION

1. Field of the Invention

The present invention relates to an apparatus for collecting cigarette smoke, ash and cigarette ends which is able to efficiently and safely collect cigarette ends, cigarette smoke being emitted from a half-smoked cigarette, which is placed in an ashtray, in amusement places such as pachinko parlors, places where a number of people gather, such as a waiting room, and at counters of restaurants.

2. Description of the Prior Arts

Conventionally, ashtrays which are disposed in pachinko parlors or places where a number of people gather are placed at an appropriate interval, and cigarette ends and ash in these ashtrays are collected by employees. Therefore, there are various problems where collection of such cigarette ends and ash may disturb people's recreation or games and where ash is scattered in the surroundings and cause people to experience a sense of unpleasantness.

Therefore, in order to solve these and other problems, various studies and researches have been carried out, whereby the following apparatus has been disclosed.

a. In Japanese Utility Model Publication No. Sho-56-3027 (hereinafter merely called publication "a"), a cigarette end collecting apparatus on a pachinko machine island is disclosed, in which cigarette ends dropped from cigarette insertion ports which are respectively installed on the upper surface of the front racks of a pachinko machine island corresponding to the respective pachinko machines are accumulated in a duct through chutes and are collected by a fluid travelling in said duct, and the cigarette ends are able to be collected island by island.

b. In Japanese Patent Publication No. Hei-3-8236 (hereinafter merely called publication "b"), another cigarette end collecting apparatus is disclosed, wherein the bottom surface of ashtrays installed to protrude from the forward side of each pachinko machine disposed in a row is formed to be retiform so as to facilitate the dropping of cigarette ends, a belt conveyor which causes the downside of said ashtrays of the respective pachinko machines to be communicated with each other, carries the cigarette ends dropped from the bottoms of said ashtrays and conveys the cigarette ends from one side to the other side of a series of pachinko machines disposed in a row is installed so as to cause the belt thereof to be rotatable with the belt being made of a water sucking material, a liquid supplementing device which supplies a liquid agent in order to extinguish the cigarette ends is installed for said water sucking belt, and a cigarette end collecting case which is able to store cigarette ends conveyed by said conveyor is installed at the other end of said belt conveyor.

c. In Japanese Laid-Open Utility Model Publication No. Hei-6-66772 (hereinafter merely called publication "c"), a cigarette end collecting apparatus for pachinko machines is disclosed, wherein ashtrays are installed on the base plate located at the front side of pachinko machines, an air duct which is able to pneumatically convey cigarette ends is installed, a communication path which causes said air duct and the bottom of said ashtrays to be communicated with each other is installed, a closing member which is able to open and close said communication path is installed at said communication path, an air suction machine is provided at the terminal of said air duct, a cigarette end collecting liquid tank which collects cigarette ends is provided downward of an air path between said air suction machine and said air duct.

Furthermore, there was a problem where a sense of unpleasantness was experienced by the surrounding people due to smoke emitted from half-smoked cigarettes, which are placed on an ashtray.

As a means for solving this problem, the following is disclosed.

d. In Japanese Laid-Open Utility Model Publication No. Sho-62-202196 (hereinafter merely called publication "d"), a cigarette end treating apparatus is disclosed, wherein an introduction tube is elongated downward from each ashtray and said introduction tube is connected to a collecting tube which is disposed almost horizontally or in a slightly inclined state, and a cleaner and a collecting box are attached to one of said collecting tubes.

Furthermore, a pattern of ashtrays employed in this cigarette end treating apparatus is such that half-smoked cigarettes may be placed on the ashtrays, smoke emitted from cigarettes is sucked into the introduction tube through the ashtrays, and cigarette ends may be dropped from the bottom of ashtrays into the introduction tube.

Furthermore, with a cigarette end collecting apparatus, since cigarettes are not completely extinguished, there was a problem that a fire might be caused while collecting cigarette ends.

In order to solve this problem, the following has been disclosed.

e. In Japanese Laid-Open Utility Model Publication No. Hei-5-68297 (hereinafter merely called publication "e"), a cigarette end collecting apparatus has been disclosed, which comprises a table plate in which a plurality of ashtrays having through holes formed therein are placed and in which said through holes are made, and a water path tube which has a water supply tube connected to one end thereof and a water discharge tube connected to the other end thereof, wherein said water path tube is attached below said table plate and cigarette ends are caused to be dropped into said water path tube through said through holes of said ashtrays.

f. In Japanese Laid-Open Patent Publication No. Hei-6-254255 (hereinafter merely called publication "f"), a water type cigarette end collecting apparatus has been disclosed, wherein ashtrays are installed on the base plate, provided at the front side of a plurality of pachinko machines installed in a row, on which pachinko machine accommodating cases are placed, a water path tube is provided downward of said base plate, cigarettes are caused to be dropped into said water path tube with the bottom of said ashtrays and the base plate opened, and water in the water path tube is circulated via a purification section which is able to purify water by eliminating cigarette ends and tobacco ash contained therein.

However, the abovementioned conventional cigarette end collecting and/or treating apparatuses still have the following problems. That is, since there is a considerable fear that pieces of paper, chewing gum, and the like may be dropped in ashtrays in addition to cigarette ends, there is such a problem that in a cigarette end collecting apparatus utilizing a travelling fluid according to said publication "a", a cigarette end collecting apparatus utilizing a conveyor belt according to said publication "b", and a cigarette end collecting apparatus utilizing air suction according to said publications "c" and "d", chewing gum may be stuck to the inside of the system while transferring the same, and pieces of paper and cigarette ends are further stuck to said chewing gum, whereby the collecting tube thereof may be clogged.

Furthermore, in cigarette end collecting apparatuses described in publications "a", "b", "c" and "d", there is a danger that a fire may be caused unless the cigarettes are completely extinguished. Therefore, there is such a problem where the safety is not sufficient.

With the conventional cigarette end collecting apparatus described in publication "e", there is still another problem that smoke emitted from half-smoked cigarettes which are placed in ashtrays was not able to be prevented from spreading to the surroundings. Furthermore, since the bottom of ashtrays has a closing coverlid, the structure thereof is complicated, and it is necessary to expressly open and close the closing coverlid when dropping ash and cigarette ends into a water path tube. Therefore, if a smoker forgets to open and close the coverlid, cigarette ends, etc. are accordingly accumulated in ashtrays and the accumulated cigarette ends drops into a water path tube at one time, there is a problem that the water path tube may be clogged. Still furthermore, in a case where the water path tube is clogged with cigarette ends, water contained in the water path tube may overflow through ashtrays.

With the conventional cigarette end collecting apparatus described in publication "f", there is a problem that smoke emitted from half-smoked cigarettes which are placed on ashtrays was not able to be prevented from spreading to the surroundings. Furthermore, since the bottom of ashtrays has a closing coverlid, the structure thereof is complicated, and it is necessary to expressly open and close the bottom plate when dropping ash and cigarette ends into a water path tube. Therefore, if a smoker forgets to open and close the bottom plate, cigarette ends, are accordingly accumulated in ashtrays and the accumulated cigarette ends drops into a water path tube at one time, there is a problem that the water path tube may be clogged. Still furthermore, in a case where the water path tube is clogged with cigarette ends, water contained in the water path tube may overflow through ashtrays.

SUMMARY OF THE INVENTION

It is therefore an object of the invention to provide a smoke and cigarette end collecting apparatus which is able to safely collect cigarette ends, pieces of paper, chewing gum, and the like dropped into ashtrays and to completely eliminate smoke emitted from half-smoked cigarettes which are placed on ashtrays, and which is suitable for mass production with its simplified structure.

A more specific object of the invention is to provide an apparatus for collecting cigarette smoke, ash and cigarette ends, which is able to collect cigarette ends, pieces of paper, chewing gum, and the like which are dropped through the ashtray section, at the filter section of a water tank, thereby causing the collection efficiency of these things to be remarkably improved. With the apparatus, it is possible to eliminate smoke emitted from half-smoked cigarettes which are placed on the ashtray section, without being scattered to the surrounding. Still furthermore, since cigarette ends are dropped into a water path tube, the safety can be much improved by completely extinguishing a cigarette. Still furthermore, since no cigarette ends are accumulated in the ashtray section, the ashtray section can be always kept clean to contribute to a saving of man power required for cleaning work. With the simple structure, it is easy to carry out maintenance, the durability is much improved, and the apparatus is most suitable for mass production.

According to one feature of the invention, it is possible to collect cigarette ends, pieces of paper, chewing gum, and the like by causing the cigarette ends, pieces of paper, chewing gum, and the like to flow with water streams in the water path tube.

According to another feature of the invention, by only attaching a water path tube to the side walls, it is possible to adjust the height of chutes and to remarkably increase the working efficiency of the installation work.

According to still another feature of the invention, even though the water path tube is clogged and all the water in the water tank is fed into the water path tube, it is possible to prevent water from overflowing, whereby pachinko machines and the apparatus can be protected from any accident due to water leakage.

According to further another feature of the invention, in a case where a water quantity abnormality should occur in the water path tube due to a clogging of the water path tube, the water feeding can be instantly stopped to prevent water from overflowing, whereby pachinko machines and the apparatus can be prevented from any accident due to water leakage.

According to another feature of the invention, since ashtray sections can be easily removed, it is easy to clean up the ashtray sections and chutes, whereby it is possible to keep the ashtray sections clean, which contributes to facilitating the maintenance.

According to one advantage of the invention, since only smoke can be sucked in without sucking in water and cigarette ends streaming in the water path tube, the blower, can be protected from any accident to contribute to improving the durability.

Furthermore, according to another advantage of the invention, since it is possible to prevent the atmospheric air in a play room from being contaminated and to prevent odor due to nicotine, from occurring, the atmospheric air in the play room can be purified and much improved.

Furthermore, according to still another advantage of the invention, since it is possible to separate and collect cigarette filters, cigarette paper, one after another, it is possible to prevent the filter sections from being clogged.

Still furthermore, according to further another advantage of the invention, water can be prevented from being splashed around the water tank, it is possible to prevent the surrounding thereof from being made dirty.

According to another advantage of the invention, since ash, is able to be prevented from directly dropping into the pump chamber, it is possible to prevent a pump from seizing due to minute dirt and dust such as ash in water.

Furthermore, according to still another advantage of the invention, it is possible to install an apparatus for collecting cigarette smoke, ash and cigarette ends at any places such as game tables installed along the walls in all four directions in a room, counters in restaurants, waiting rooms in an airport, or the like and at any places having circular or curved sections.

The above-mentioned objects, features and advantages of the invention will become more apparent by reference to the following description of preferred embodiments of the invention taken in conjunction with the accompanying drawings.

DESCRIPTION OF THE PREFERRED EMBODIMENTS

Figure 1:
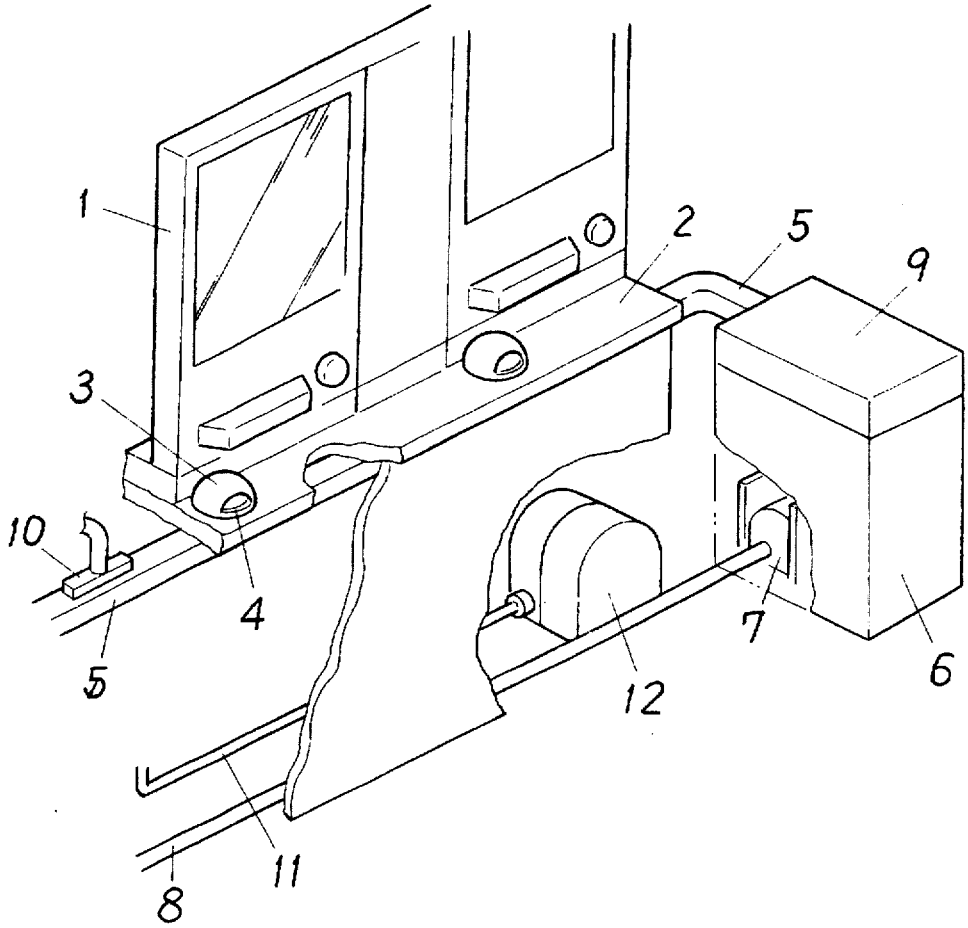
FIG. 1 is a perspective view of major parts of an apparatus for collecting cigarette smoke, ash and cigarette ends, according to the first preferred embodiment of the invention.

In order to solve these and other problems, an apparatus for collecting cigarette smoke, cigarette ends, etc. according to the invention is constructed so as to comprise a water path tube disposed below a base plate, etc., and having an appropriate inclination angle; ashtray sections disposed on the surface of said base plate at an appropriate interval; cigarette ends, etc. dropping sections disposed at the middle part below said ashtray sections and for dropping cigarette ends and ash; a hole part drilled at the middle of said cigarette ends, etc. dropping sections; a chute formed at an appropriate interval at said water path tube which is internally or externally fitted at said cigarette ends etc., dropping sections of said ashtray sections; a water tank disposed at the downstream side of said water path tube; a pump for feeding water in said water tank into said water path tube; a water feeding tube which connects said pump with said water path tube; one or more suction ports disposed on the upper surface in the lengthwise direction of said water path tube; a suction tube which connects to said suction ports; and a suction section, consisting of a blower, etc., which is connected to said suction tube.

With this construction, an apparatus for collecting cigarette smoke, cigarette ends, etc. according to the invention has actions by which cigarette ends, pieces of paper, chewing gum, etc., dropped into ashtrays are able to be further dropped into a water path tube and safely collected, and smoke emitted from half-smoked cigarettes which are placed on ashtrays is able to be completely eliminated without spreading to the surrounding.

An apparatus for collecting cigarette smoke, cigarette ends, etc. according to claim 1 of the invention is provided with a water path tube disposed below a base plate, etc., and having an appropriate inclination angle; ashtray sections disposed on the surface of said base plate at an appropriate interval; cigarette ends, etc. dropping sections disposed at the middle part below said ashtray sections and for dropping cigarette ends and ash; a hole part drilled at the middle of said cigarette ends, etc. dropping sections; a chute formed at an appropriate interval at said water path tube which is internally or externally fitted at said cigarette ends etc., dropping sections of said ashtray sections; a water tank disposed at the downstream side of said water path tube; a pump for feeding water in said water tank into said water path tube; a water feeding tube which connects said pump with said water path tube; one or more suction ports disposed on the upper surface in the lengthwise direction of said water path tube; a suction tube which connects to said suction ports; and a suction section, consisting of a blower, etc., which is connected to said suction tube. The apparatus has actions by which cigarette ends, pieces of paper, chewing gum, etc., dropped into ashtrays are able to be further dropped into a water path tube and safely collected, and smoke emitted from half-smoked cigarettes which are placed on ashtrays is able to be completely eliminated without spreading to the surrounding. Furthermore, with this apparatus, cigarette ends are not accumulated in ashtrays and the ashtray sections are able to be kept clean at all times.

Still furthermore, since said ashtray sections may be formed to be integral with said cigarette ends, etc. dropping sections disposed at the middle part below said ashtray sections, it is possible to decrease the number of components and to reduce the number of processes, whereby the productivity will be able to be much improved. Furthermore, although the cross-section of said water path tube may be circular, elliptical or polygonal, it is preferable that the cross-section is rectangular, at the standpoint of easy attaching of said water path tube and said one or more suction ports disposed on the upper surface in the lengthwise direction of said water path tube.

The apparatus for collecting cigarette smoke, cigarette ends, etc. is formed so that the inclination angle of said water path tube is 0.3° to 5°, preferably 0.5° to 1.5°, whereby it is possible to convey cigarette ends, pieces of paper, chewing gum, etc. in the water path tube with a water stream circulating therein.

For example, in a case where the apparatus for collecting cigarette smoke, cigarette ends, etc. is installed for pachinko machines of a double-sided island type, it is preferable that the length of said water path tube is made almost one half of the pachinko machine row and said water path tube is formed so as to have an inclination angle of about 1° from the middle part of said pachinko machine row in the left and right directions.

Furthermore, in a case where the apparatus for collecting cigarette smoke, cigarette ends, etc. is installed for pachinko machines of a single-sided island type, it is preferable that the length of said water path tube is made almost the same as that of the pachinko machine row and the water path tube is formed so as to have an inclination angle of about 0.5°.

The apparatus for collecting cigarette smoke, cigarette ends, etc. is formed so that the length of said chutes is made longer from the upstream side to the downstream side and the upper ends of the chutes are made horizontal when they are installed, whereby it is possible to easily provide said water path tube with an appropriate angle when being attached.

The apparatus for collecting cigarette smoke, cigarette ends, etc. is constructed so that the inner capacity of said water path tube is larger than the water capacity of said water tank and the discharge quantity (P) of said pump has the following relationship with respect to the water capacity ($V_1$) of said water tank and the capacity ($V_2$) of said water path tube:

$$V_1 \leqq P \leqq V_2$$

whereby in a case where all the water in said water tank is fed into said water path tube due to a clogging of said water path tube, it is possible to prevent water from overflowing.

The apparatus for collecting cigarette smoke, cigarette ends, etc. is formed so that said water path tube is provided with a water quantity detecting section such as a water temperature sensor, optical sensor, etc. whereby said water quantity detecting section detects an excessive rise of water quantity due to a clogging of said water path tube and it is possible to prevent water from being overflown.

For example, by providing an electric interlock between said water quantity detecting section and a pump motor, the power source of said pump motor is switched off to stop the circulation of water, and the water feeding is accordingly stopped.

The apparatus for collecting cigarette smoke, cigarette ends, etc. and is constructed so that said cigarette ends, etc. dropping sections are formed to be cylindrical and are slidably fitted to the inside or outside of said chutes via a sliding member such as an O ring, etc, whereby since said ashtray sections can be easily removed, it is easy to clean said ashtrays and said chutes, and said ashtray sections can be kept clean at all times. Furthermore, since O rings are used at the fitting surface between said cigarette end, etc. dropping section and said chute, the fitting surface therebetween is able to be completely sealed.

Furthermore, in addition to an O-ring as a sliding member, a packing, etc. may be used to have the same effects. It is preferable to use a teflon packing having a self-lubricating property in view of the installation efficiency.

The apparatus for collecting cigarette smoke, cigarette ends, etc. is constructed so that said suction ports are provided with a pressure absorbing section for preventing water and cigarette ends circulating in said water path tube from being sucked, whereby it is possible to provide an action of sucking in only smoke without sucking in water and cigarette ends circulating in said water path tube.

The apparatus for collecting cigarette smoke, cigarette ends, etc. and is provided with a dust collecting section disposed at said suction sections for collecting nicotine, etc. of smoke; and a deodorization section or a perfume spraying section, which is disposed at the discharge section of said suction section, whereby it is possible to prevent the room atmosphere from being contaminated and to prevent odors from being emitted due to nicotine, etc.

Furthermore, in cases where a deodorizing section or a perfume spraying section is to be provided, it is desirable to provide a duct, etc. so that the discharge from the discharge section of the suction section will be supplied to the interior of the room.

The apparatus for collecting cigarette smoke, cigarette ends, etc. is provided with filter sections respectively having different meshes in said water tank thereof, whereby it is possible to separate and collect cigarette filters, cigarette paper, tobacco cuts, etc., one after another.

Furthermore, it is possible to provide said water tank with three kinds of filters, for example, a coarse-meshed filter, a medium-meshed filter and a fine-meshed filter.

The apparatus for collecting cigarette smoke, cigarette ends, etc. is equipped with a water drop splashing prevention section at said water tank and at the ends of said water tank side of said water path tube, whereby it is possible to prevent water drops from being splashed around said water tank.

Furthermore, said water drop splashing prevention section may be made of synthetic resin, sheet zinc, etc.

The apparatus for collecting cigarette smoke, cigarette ends, etc. and is constructed so that said pump is provided with pump chamber side walls disposed in said water tank and erected at the bottom of said water tank at the circumference thereof, a pump chamber formed by said pump chamber side walls, and a covering section disposed on the upper surface of said pump chamber with a clearance secured, whereby it is possible to prevent ash from dropping directly into said pump and to prevent said pump from sucking in minute dust and dirt such as ash in the circulating water.

Furthermore, said pump may be disposed outside said water tank, and in a case where the pump is disposed outside the water tank, the pump may be connected to the water tank with a tube. If a partition plate, etc. which is able to eliminate minute ash, etc. in the circulating water is disposed at the connection thereof, said partition plate may have an effect similar to that of said pump chamber side walls and said covering member.

The apparatus for collecting cigarette smoke, cigarette ends, etc. is formed so that said water path tube is formed to be circular or rectangular in its arrangement by making the water path tube circular or providing the same with tube curved sections, whereby said apparatus for collecting cigarette smoke, cigarette ends, etc. may be installed at places having a circular part or a curved part.

Furthermore, in order to prevent cigarette ends from being clogged in the tube curved sections of said water path tube, the radius of curvature is 50 mm to 200 mm, preferably 100 mm to 120 mm.

A first preferred embodiment of an apparatus for collecting cigarette smoke, cigarette ends, etc. according to the invention is described, using an example that the same apparatus is installed in a pachinko machine row, with reference to FIG. 1 to FIG. 6.

Figure 2:
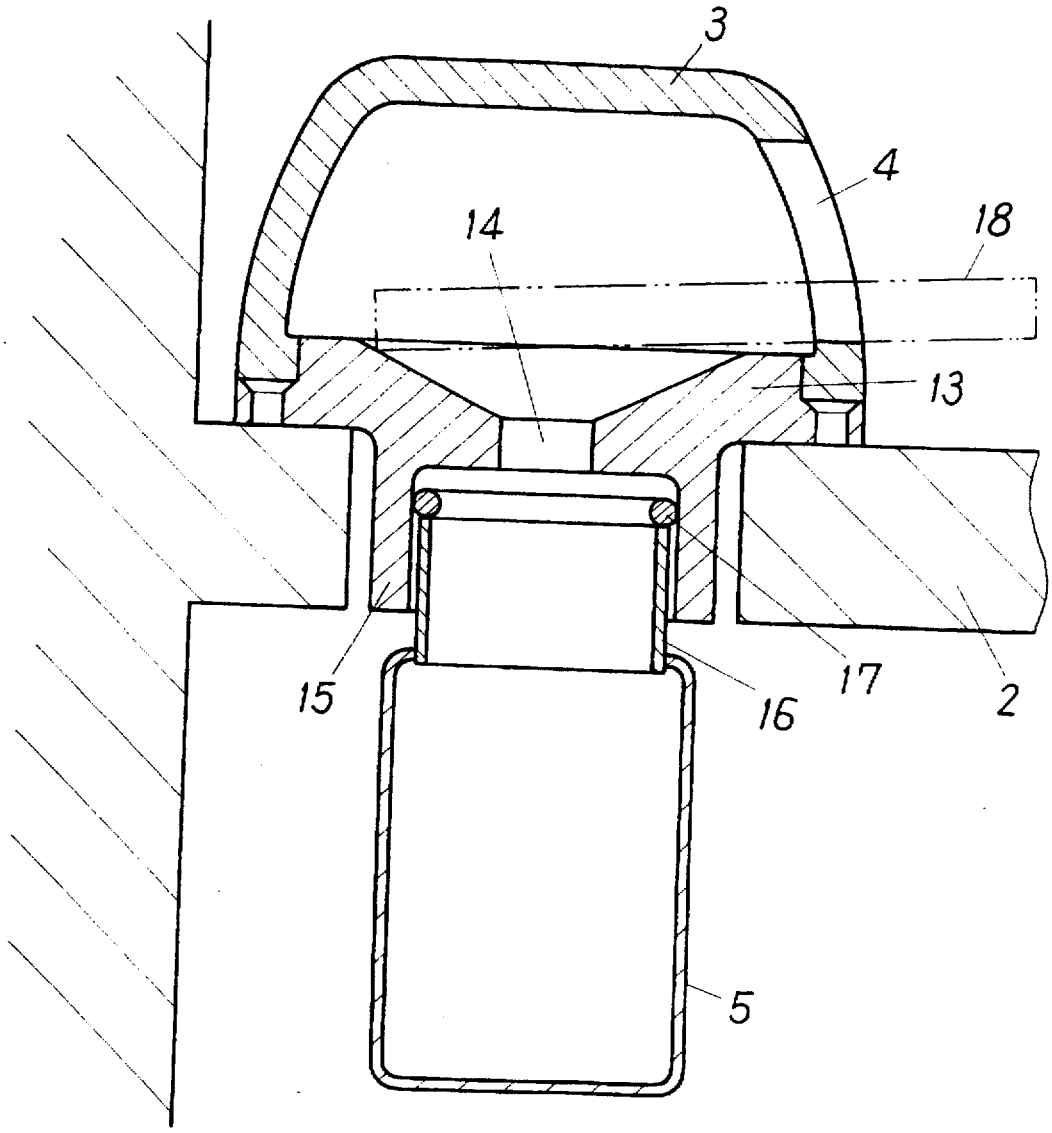
FIG. 2 is a cross-sectional view of major parts of an ashtray section of the first preferred embodiment.
Figure 3:
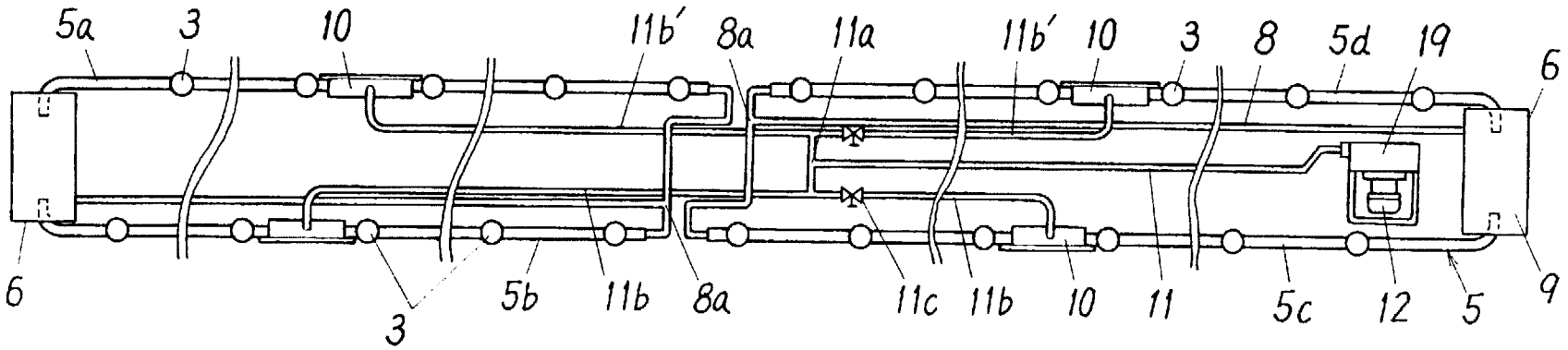
FIG. 3 is a plan view of major parts showing an state where the apparatus according to the first preferred embodiment is installed for pachinko machines of a double-sided island type.
Figure 4:
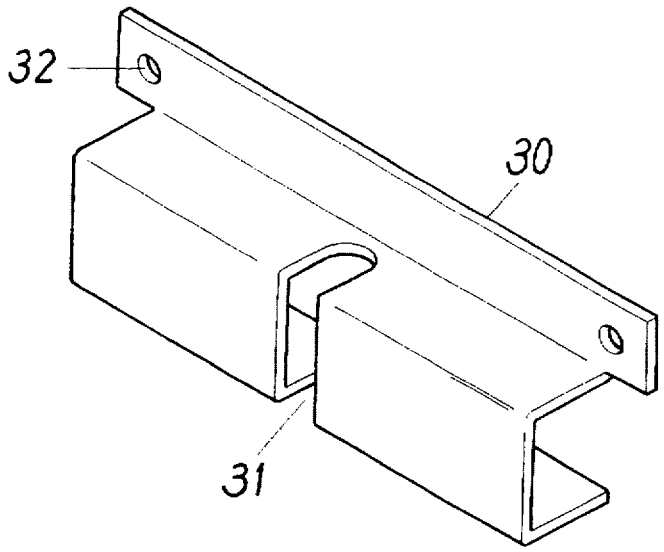
FIG. 4 is a perspective view of fixing members which fix a water path tube.
Figure 5:
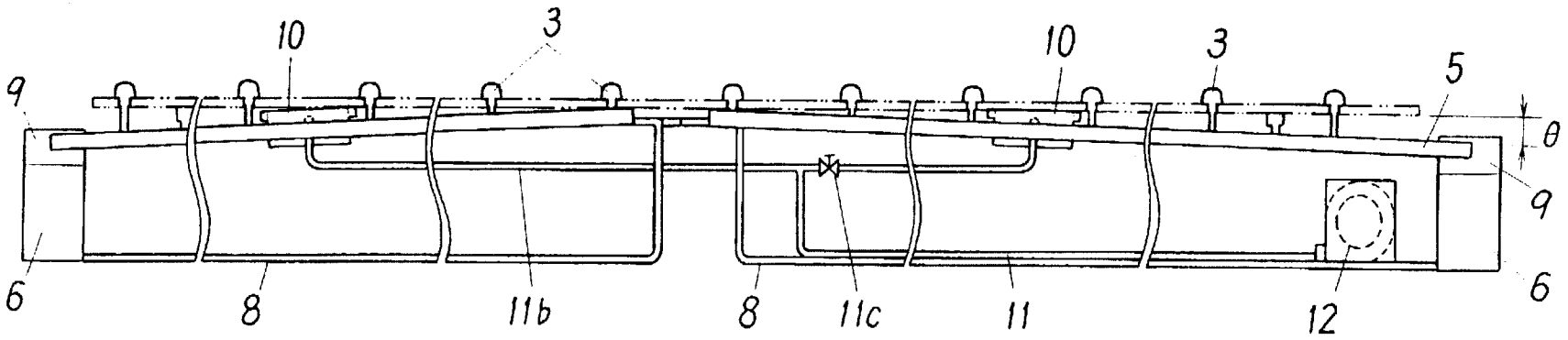
FIG. 5 is a side elevational view of major parts in FIG. 3.

FIG. 1 is a perspective view showing major parts of the apparatus for collecting cigarette smoke, cigarette ends, etc. according to the first preferred embodiment, FIG. 2 is a cross-sectional view showing major parts of an ashtray section, FIG. 3 is a plan view of major parts showing a state where the apparatus according to the first preferred embodiment is installed in a double-sided island type, FIG. 4 is a perspective view of fixed members for fixing a water path tube, and FIG. 5 is a side elevational view of the major parts in FIG. 3.

In FIG. 1, 1 is a pachinko machine, 2 is a base plate which is formed so as to protrude from the front side of a pachinko machine and is used to place a ball box, etc. 3 is an ashtray section disposed on the upper surface of said base plate at an appropriate interval, 4 is an ashtray port, formed at the side of said ashtray section 3, on which a half-smoked cigarette is placed, and 5 is a water path tube having a rectangular cross section and disposed at the underside of said base plate 2 with an inclination angle θ°.

6 is a water tank disposed at the downstream side of said water path tube 5 and used for collecting water containing cigarette ends, etc. in said water path tube 5, and 7 is a pump which is disposed in said water tank 6 and feeds and circulates water in the water tank 6 to the water path tube 5. The discharge quantity (P) of said pump 7 is determined so that the pump has the following relationship with respect to the water capacity ($V_1$) of said water tank and the capacity ($V_2$) of said water path tube:

$$V_1 \leqq P \leqq V_2$$

In a case where the first preferred embodiment is installed for pachinko machines of a double-sided island type, the discharge quantity of said pump 7 is 20 liters, the capacity of the water tank 6 is 18 liters and the capacity of said water path tube 5 is 25 liters. In the first preferred embodiment, an underwater pump may be employed as pump 7. However, the pump 7 may be installed outside the tank and be connected thereto by a tube.

8 is a water feeding tube which causes the pump 7 to be communicated with the upstream side of the water path tube 5, 9 is a water drop splashing prevention section made of synthetic resin, which is fitted on the upper end face of said water tank 6 and is formed to be cover-like, 10 is a suction port which is disposed on the upper surface of the water path tube in the lengthwise direction and is used for sucking in smoke, 11 is a suction tube which is connected to said suction port 10, and 12 is a suction section consisting of a blower, etc. and connected to said suction tube 11, which is able to suck in smoke emitted from half-smoked cigarettes which are placed on the ashtray section 3 and smoke circulating in the water path tube 5 and to exhaust them directly outdoors or indoors after deodorization.

In FIG. 2, 13 is a cigarette end, etc. dropping section which is formed at the middle of the underside of the ashtray section 3 and is used for dropping cigarette ends and ash, 14 is a hole part drilled at the middle of said cigarette ends dropping section 13, 15 is a chute fitting wall section, 16 is a chute formed so that the height thereof is made gradually higher from the upstream side to the downstream side of said water path tube 5 and the upper surface level is made flush, 17 is an O ring fixed at the upper end face of said chute 16, which is slidably fitted to the inner wall of said chute fitting wall section 15, and 18 is a lighted cigarette placed at the ashtray section 3.

In FIG. 3 to FIG. 5, as has been made clear from these drawings, the apparatus for collecting cigarette smoke, cigarette ends, etc. according to the first preferred embodiment is divided into two systems at the middle part of a pachinko machine island and is attached to the side plate of a pachinko machine row.

**8*a* is a branching tube by which the water feeding tube 8 roughly uniformly divides water into two water path tubes 5*a*, 5*b* or 5*c*, 5*d*, 11*a* is a suction branching tube which sucks water into said suction tube 11 in a state where pressure is roughly uniformly reduced in suction tubes 11*b*, 11*b*, 11*b*', 11*b*' being communicated with each suction port 10 of the respective water path tubes 5*a*, 5*b*, 5*c*, 5*d*, 11*c* is a throttling valve which is used to adjust the degree of pressure reduction in the suction tubes 11*b*, 11*b* and 11*b*', 11*b*', 19 is a dust collecting section disposed at the suction section 12**.

Furthermore, said dust collecting section 19 is, if necessary, provided with a filter section for collecting dust and dirt such as ash, etc., and a nicotine eliminating section for eliminating nicotine, etc. Furthermore, if the discharge section of the suction section 12 is provided with a deodorization section for deodorizing odors in the atmosphere, giving perfumes and sterilizing and a perfume giving section for adding perfumes, aromatic, sterilizing perfumes such as fitontsid, etc., it is possible to improve the environment of a parlor. When a deodorization section and a perfume giving section are disposed, it is preferable that ducts are arranged so that the discharge section of suction section 12 is oriented indoors.

30 is a fixing member fixed with screws at the side plate section of a pachinko machine row beyond the water path tube 5, 31 is a notched section through which a suction tube 11 is passed, 32 is a screw hole for fixing with screws said fixing member 30 beyond the water path tube 5.

θ is an inclination angle at which the water path tube 5 is inclined in the lateral direction from the middle part of a pachinko machine island.

As has been made clear in FIG. 5, said water feeding tube 8 is caused to communicate with the upstream side of the respective water path tubes 5 at the middle part of the pachinko machine island, and said water path tubes 5 are disposed so that cigarette ends, etc. are positively flown along with water with the inclination angle θ.

Figure 6:
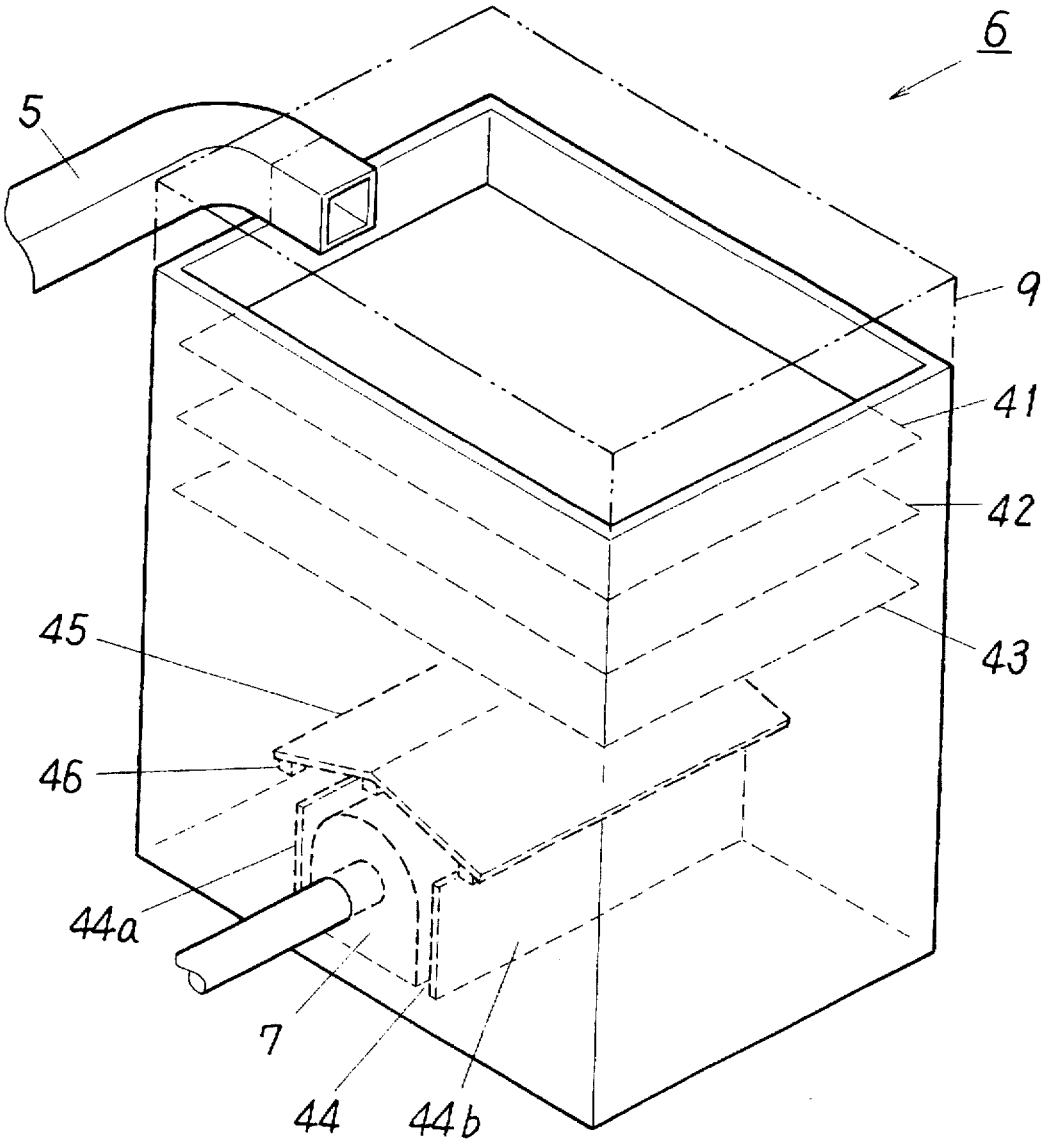
FIG. 6 is a perspective view of major parts of a water tank in the first preferred embodiment.

FIG. 6 is a perspective view of major parts of a water tank in the first preferred embodiment.

In the drawing, 41, 42, 43 are filter sections which are able to separate cigarette filters, cigarette paper, tobacco cuts, etc., from the circulating water one after another, wherein the meshes of these filters are made finer one after another. 44 is a pump chamber having an opening on the upper surface thereof, which is formed at the bottom of the water tank 6, **44*a*, 44*b* are pump chamber side walls erected from the bottom in order to prevent ash, etc. from entering the pump chamber 44, thereby preventing the pump 7 from being clogged, 45 is a covering member which is able to prevent ash from directly dropping into the pump chamber 44 by covering up the upper surface of the pump chamber 44 just like a roof with a clearance secured therebetween, and 46 is an engaging section which supports the covering member 45 on the upper surface of the pump chamber 44**.

Figure 7:
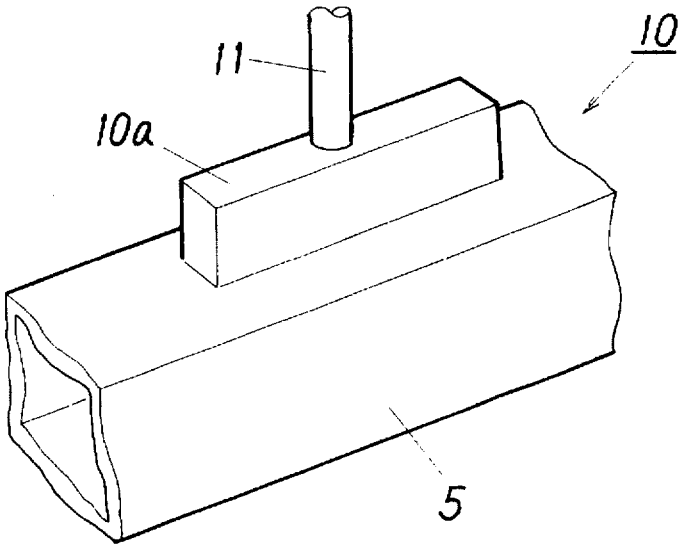
FIG. 7 is a perspective view of major parts of a suction port in the first preferred embodiment.

FIG. 7 is a perspective view of major parts of the suction port in the first preferred embodiment. As been made clear in the drawing, the suction port 10 has a pressure absorbing section **10*a* which reduces the suction pressure and is protrudingly formed as a pressure absorbing zone in order to prevent water, cigarette ends, etc. in the water path tube 5** from being sucked.

Figure 8:
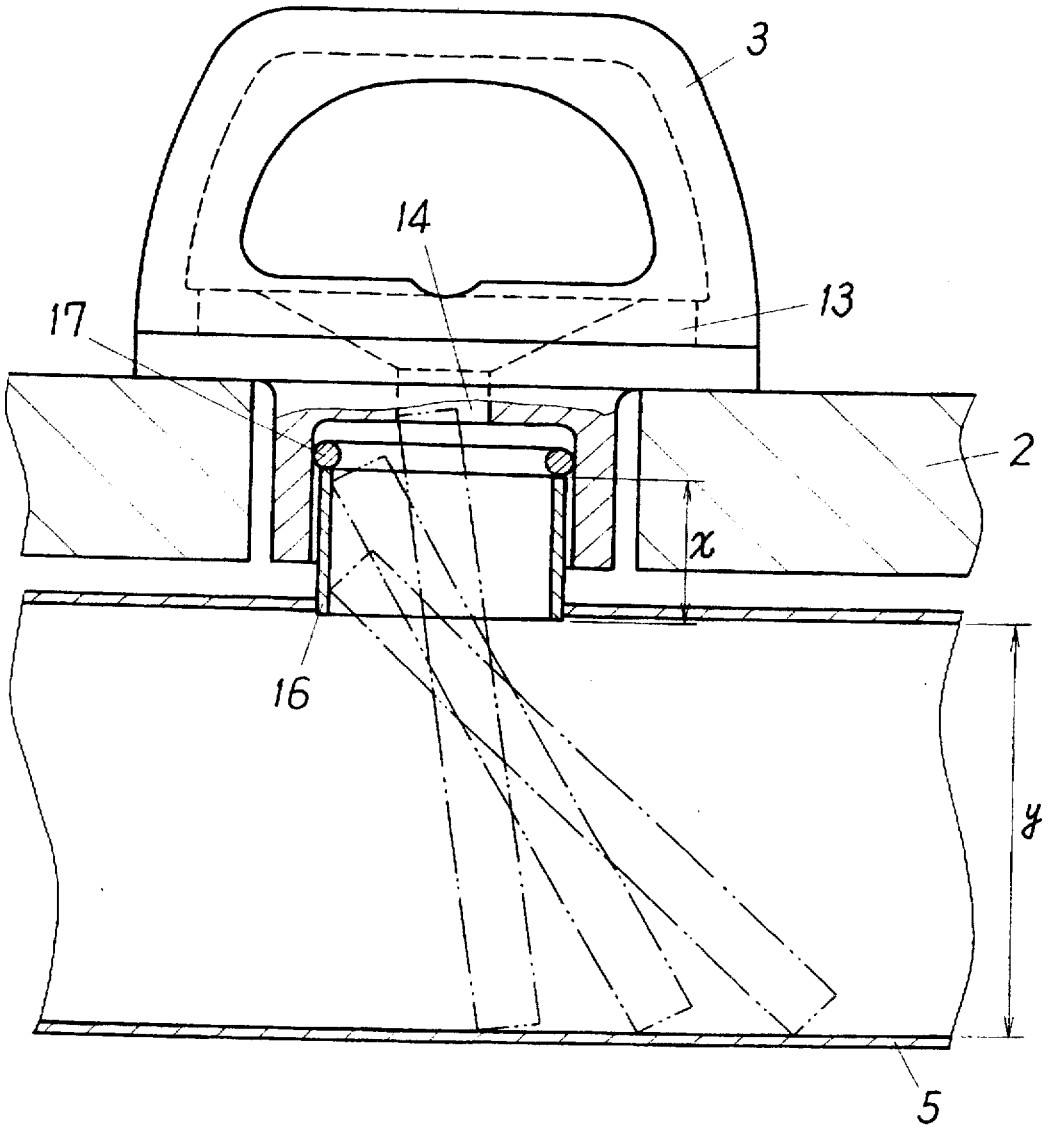
FIG. 8 is a perspective view of major parts showing a streaming state of cigarette ends.

FIG. 8 is a perspective view of major parts showing a circulating state of cigarette ends, etc.

In the same drawing, x is the length of chutes, and y is the height of the inner wall of the water path tube 5. The total length (x+y) of the water path tube 5 and chute 16 is formed to be 60 mm $\leqq (x+y) \leqq$ 450 mm, preferably 80 mm $\leqq (x+y) \leqq$ 200 mm. If (x+y) is smaller than 60 mm, in a case where an unlit cigarette is dropped into the hole part 14 of the cigarette end, etc. dropping section 13, there is a fear that the cigarette will not be able to flow. Furthermore, if (x+y) exceeds 450 mm, the pressure loss of the suction section 12 is made large, the motor capacity of the suction section 12 must be increased.

A description is given of the operations of the apparatus for collecting cigarette smoke, cigarette ends, etc. of the first preferred embodiment constructed above.

Water in a water tank 6 is sucked up by a pump 7 and is circulated into a water path tube 5 from the upstream side of the water path tube 5 via a water feeding tube 8.

A lighted cigarette 18 is placed at an ashtray port 4, and smoke emitted from the cigarette 18 is sucked into the water path tube 5 from a hole part 14 of a cigarette ends, etc. dropping section 13 via a chute 16 by a suction section 12. At this time, only smoke is sucked in by a pressure absorbing section **10*a* of the suction port 10. The sucked smoke is exhausted via a deodorization section or a perfume giving section of the discharge section of the suction section 12 after dirt and dust such as ash are collected from the suction tube 11 via a dust collecting section 19 of the suction section 12**.

Ash from the cigarette 18 and cigarette ends are dropped from the hole part 14 of the cigarette ends, etc. dropping section 13 into the water path tube 5 in which water is circulating, via the chute 16, wherein the cigarette 18 ends dropped into the water path tube 5 are transferred into the water tank 6 along with water circulating in the water path tube 5.

The cigarette ends transferred into the water tank 6 are separated into cigarette filters, cigarette paper, tobacco cuts, etc., one after another by three kinds of filters 41,42,43 attached to the water tank 6 and collected from the water, whereby only water is caused to flow in the water tank 6.

Water flown into the water tank 6 is purified by eliminating ash contained the water via the pump chamber side walls **44*a*, 44*b*, which covers the surrounding of the pump 7 and a covering member 45, and is caused to flow into the pump chamber. Again, the water is sucked up and is circulated into the upstream side of the water path tube 5 via the water feeding tube 8**.

Furthermore, even in a case where an unlit cigarette 18 is dropped into the hole part 14 of the cigarette ends, etc. dropping section 13, the cigarette 18 is able to flow into the water path tube 5 without being clogged in the chute 16 as shown in FIG. 8.

Still furthermore, even though pieces of paper, chewing gum, etc. are dropped from the hole part 14 of the cigarette ends, etc. dropping section 13, they are also able to flow together with water circulating the water path tube 5 and to be separated from the filter sections 41,42,43 attached to the water tank 6.

Since the apparatus for collecting cigarette smoke, cigarette ends, etc. according to the first preferred embodiment is constructed as shown above, the same will be able to operate as shown below.

Since cigarette ends are transferred by water circulating in the water path tube, the cigarette can be instantly extinguished even though a lighted cigarette is dropped into the water path tube, whereby it is possible to easily collect cigarette ends safely. Furthermore, even though chewing gum is dropped into the water path tube, it is cooled down to be solidified by water circulating in the water path tube, whereby it is possible to transfer chewing gum to the water tank side without adhering to the water path tube and to prevent the water path tube from being clogged due to cigarette ends being adhered to chewing gum. Furthermore, no cigarette ends are accumulated on the ashtray section, and the ashtray section can be kept clean at all times.

Since the water path tube is disposed at an appropriate inclination angle, it is possible to transfer cigarette ends, pieces of paper, chewing gum, etc., by water streams in the water path tube.

Since the height of chutes is made longer from the upstream side to the downstream side and the chutes are finally made flush on their .upper surfaces, it is possible to easily install the water path tube so as to have an appropriate inclination angle.

Even though an unlit cigarette is dropped into a chute, it does not cause the chute to be clogged, and the cigarette can be flown into the water path tube.

Since the capacity of the water path tube is made larger than the capacity of the water tank and the discharge quantity (P) of said pump has the following relationship with respect to the water capacity ($V_1$) of said water tank and the capacity ($V_2$) of said water path tube: $V_1 \leqq P \leqq V_2$, it is possible to prevent water from being overflown even though the water path tube is clogged and all the water in the water tank is transferred into the water path tube tank.

Since the chute fitting wall is slidably applied to the inside or outside of a chute via a sliding member such as an O ring, etc., it is easy to remove the ashtray sections, and it is also easy to clean up the ashtray sections and chutes, whereby it is possible to keep the ashtray sections clean at all times.

Since the suction port is provided with a pressure absorbing section, it is possible to suck in only smoke emitted from half-smoked cigarettes which are placed on the ashtray sections without sucking in water and/or cigarette ends which are circulating in the water path tube. Therefore, it is possible to eliminate smoke without the same leaking outside.

Dirt and dust such as ash included in smoke sucked in by the suction section are also collected by a dust collecting section which collects nicotine, etc. of smoke of the suction section and the remaining air is exhausted via a deodorization section, perfume adding section, etc. of the discharge section of the suction section. Therefore, it is possible to prevent-the air in the room from being contaminated and possible to prevent odors due to nicotine, etc. from being emitted.

Since the water tank is furnished with a filter section having different meshes, whereby it is possible to separate cigarette filters, cigarette paper, tobacco cuts, etc., one after another for collection.

Since a water drop splashing prevention section is secured at the water tank and the end section at the water tank side of the water path tube, it is possible to prevent water from being splashed to the surroundings of the water tank.

In a case where a pump is installed in the water tank, since a pump is installed in the pump chamber consisting of pump chamber side walls erected from the bottom of the water tank and a covering member, it is possible to prevent ash from directly dropping into the pump, whereby it is possible to prevent the pump from sucking in minute dirt and dust such as ash in water.

With respect to an apparatus for collecting cigarette smoke, and cigarette ends, according to the invention, a second preferred embodiment which is provided with a water quantity detecting section at the side wall of the water path tube 5 is described with reference to FIG. 9.

Figure 9:
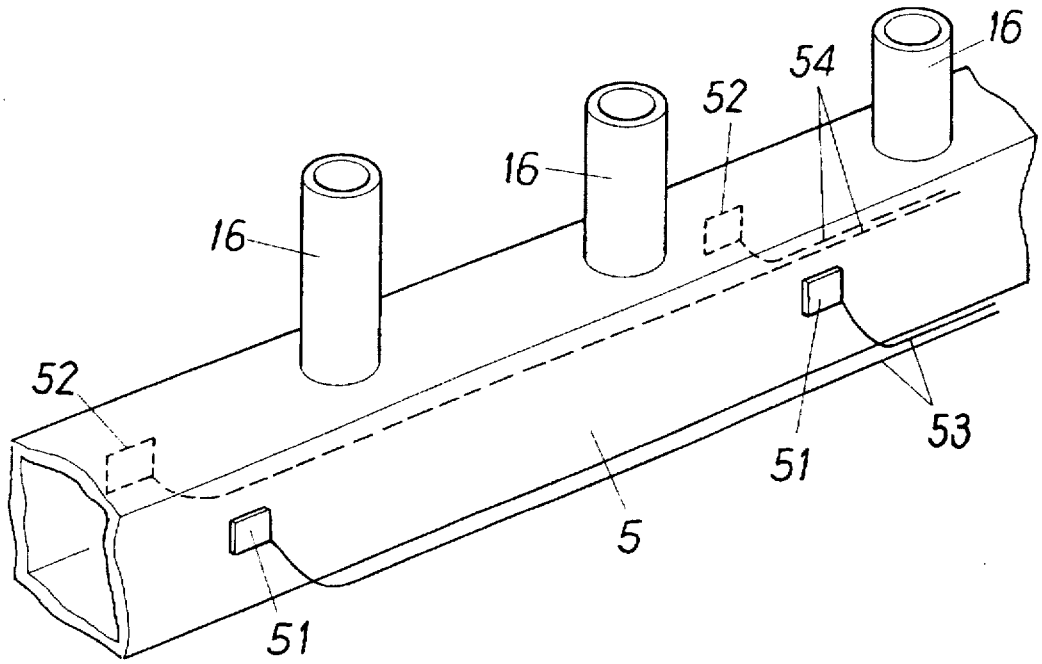
FIG. 9 is a perspective view of major parts of a water path tube in the second preferred embodiment of the invention.

FIG. 9 is a perspective view of major parts of the water path tube in the second preferred embodiment.

In FIG. 9, 51, 52 are a water quantity detecting section such as a water temperature sensor, optical sensor, etc. which is disposed at the side wall of the water path tube 5 at an appropriate interval, and 53, 54 are a wiring section for connecting the water quantity detecting section to a control section, etc.

In the second preferred embodiment of the invention, in a case where the water quantity is extraordinarily increased in the water path tube 5 due to a clogging of the water path tube 5, the water quantity detecting sections 51,52 detect a water quantity abnormality in the water path tube 5, whereby signals are transmitted to the control section, etc. by the wiring sections 53,54 in order to enable an electric interlock with the pump motor. Therefore, the power source of the pump motor is switched off to cause the pump motor to stop. Accordingly, the water feeding is stopped.

Thereby, in a case where a water quantity abnormality occurs in the water path tube 5, since the water feeding is able to be instantly stopped, it is possible to prevent water from overflowing from the water path tube 5.

A description is given of a third preferred embodiment of the apparatus for collecting cigarette smoke, cigarette ends, according to the invention, which is installed at a place having a circular or a curved section.

In the third preferred embodiment, the curved tube section of the water path tube 5 is formed by bending the same at a radius of curvature 100 mm to 120 mm, whereby it is possible to prevent cigarette ends from being stopped up at the curved section of the water path tube. Furthermore, said apparatus for collecting cigarette smoke, cigarette ends, etc. is able to be installed for game tables placed along the walls in all four directions in a place of amusement such as a casino and at places having circular or curved sections such as counters of restaurants.

Figure 10:
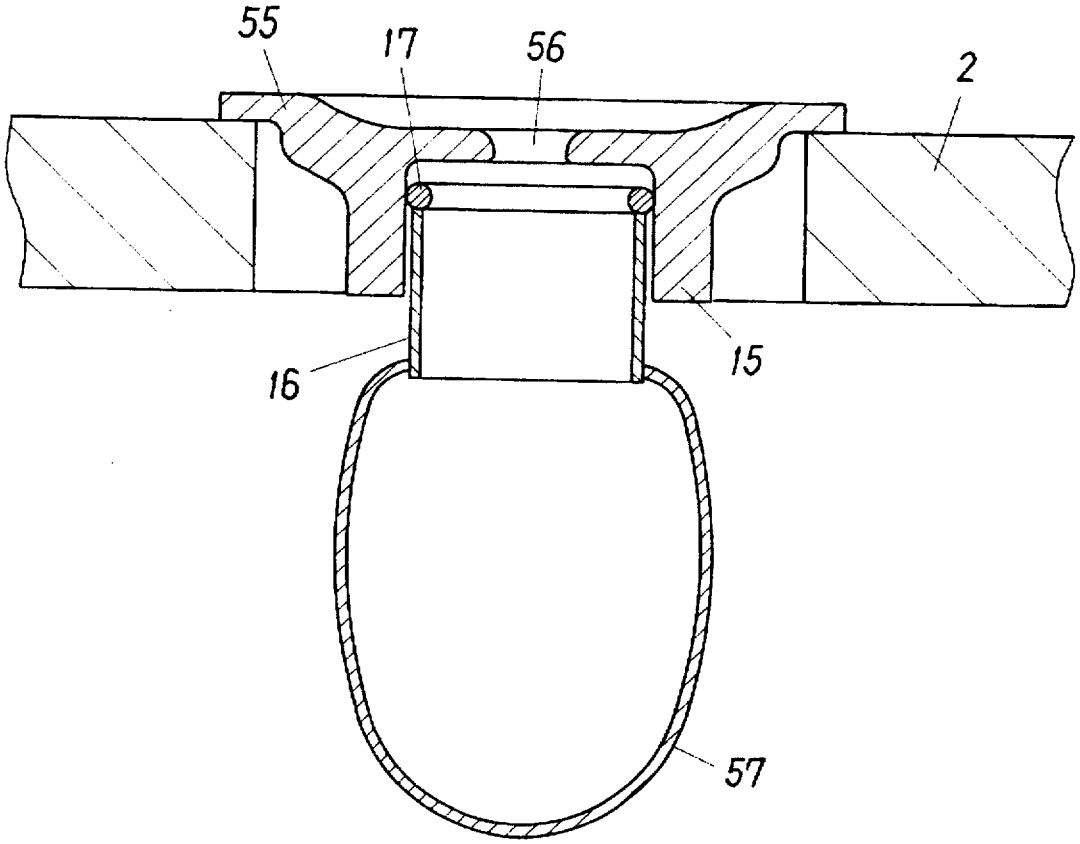
FIG. 10 is a cross-sectional view of major parts of the apparatus for collecting cigarette smoke, ash and cigarette ends according to the fourth preferred embodiment.

With reference to FIG. 10, a description is given of a fourth preferred embodiment of the apparatus according to the invention, which is installed for game tables such as billiards, roulette, etc. around which players play as they are standing.

FIG. 10 is a cross-sectional view of major parts of the apparatus for collecting cigarette smoke, cigarette ends, etc. according to the fourth preferred embodiment. The components which are identical to those in the first preferred embodiment are given the same reference numerals, and the description thereof is omitted.

In FIG. 10, 55 is an ashtray and cigarette ends, etc. dropping section in which an ashtray section having a flush surface disposed on the upper surface of the base plate 2 and a cigarette ends, etc. dropping section are made integral with each other, 56 is a hole part drilled at the middle of the ashtray and cigarette ends, etc. dropping section 55, 57 is a water path tube of which the cross-section is elliptical, disposed below the chute 16.

Furthermore, the material of the ashtray and cigarette ends, etc. dropping section may be stainless steel or ceramic. Since the upper surface of the ashtray and cigarette ends, etc. dropping section 55 is exposed to the outside, ceramic is preferable to obtain a beautiful appearance. Furthermore, the diameter of the hole part 56 secured at the middle of the ashtray and cigarette ends, etc. dropping section 55 may be made smaller than that of the hole part 14 drilled at the middle of the cigarette ends, etc. dropping section 13, which is shown in FIG. 2 showing the first preferred embodiment, whereby it is possible to prevent small things from dropping into the water path tube 57, to increase the suction force of cigarette smoke and ash, and to prevent cigarette smoke, ash, etc. from being scattered.

The fourth preferred embodiment is different from the first preferred embodiment in that, instead of an ashtray section 3 and a cigarette ends, etc. dropping section 13 of the first preferred embodiment, the fourth preferred embodiment is provided with an ashtray and cigarette ends, etc. dropping section of which the top is open and the cross section of the water path tube 56 is elliptical.

Thereby, by the ashtray and cigarette ends, etc. dropping section of which the top is open being disposed on the base plate 2, since cigarette ash can be dropped into the ashtray and cigarette ends, etc. dropping section 55 from upward of the ashtray and cigarette ends, etc. dropping section 55, the apparatus for collecting cigarette smoke, cigarette ends, etc. according to the invention can be installed at a lower part of game tables, which is accessible by extending the arm of players downward, around the game tables such as billiards, roulette, etc. for which players play as they are standing. Furthermore, since a water path tube 57 of which the cross-section is elliptical is used, no corners are formed at the bottom of the water path tube 57, whereby it is possible to instantly collect cigarette ends, etc. by water streams in the water path tube 57 without any clogging of the water path tube 57 due to cigarette ends, etc.

What is claimed is:

1. An apparatus for collecting cigarette smoke, cigarette ends and cigarette ash comprising:

a water path tube disposed below a base plate and having an appropriate inclination angle;

ash tray sections disposed on a surface of said base plate at appropriate intervals;

dropping sections disposed in a middle part of an underside of each of said ash tray sections for dropping cigarette ends and ash;

a hole part drilled at the middle of said dropping sections;

a chute depending from each of said dropping sections of said ash tray sections;

a water tank disposed at a downstream side of said water path tube;

a pump for feeding water from said water tank into said water path tube;

a water feeding tube connecting said pump with said water path tube;

at least one suction port disposed on the upper surface of said water path tube;

a suction tube connected to said at least one suction port; and a suction section comprising a blower connected to said suction tube.

2. The apparatus as set forth in claim 1, wherein the inclination angle of said water path tube is 0.3° to 5°, preferably 0.5° to 1.5°.

3. The apparatus as set forth in claim 1, wherein the length of said chutes is made progressively longer from the upstream side to the downstream side so that the upper ends of the chutes are in a common plane when installed.

4. The apparatus as set forth in claim 1, wherein said water path tube has a capacity larger than a water capacity of said water tank, and said pump has a discharge quantity (P) having the following relationship with respect to the water capacity ($V_1$) of said water tank and the capacity ($V_2$) of said water path tube:

$$V_1 \leq P \leq V_2.$$

5. The apparatus as set forth in claim 1, wherein said water path tube is provided with a water quantity detecting section.

6. The apparatus as set forth in claim 1, wherein said dropping sections are cylindrical and are slidably fitted inside said chutes by a sliding member.

7. The apparatus as set forth in claim 1, wherein said at least one suction port is provided with a pressure absorbing section for preventing water and cigarette ends circulating in said water path tube from being sucked through said at least one port.

8. The apparatus as set forth in claim 1 further comprising:

a dust collecting section connected to said suction section for collecting dust and ash; and a deodorization section connected to a discharge section of said suction section.

9. The apparatus as set forth in claim 1, wherein said water tank is internally provided with filter sections respectively having different meshes.

10. The apparatus as set forth in claim 1, wherein a water drop prevention section is connected to said water tank at an end of said water tank connected to said water path tube.

11. The apparatus as set forth in claim 1, wherein said pump is provided with a pump chamber, side walls disposed in said water tank and erected at the bottom of said water tank adjacent said pump chamber and a covering section disposed on an upper surface of said side walls in spaced relation to said pump chamber.

* * * * *